US007210445B1

(12) United States Patent
Chaney

(10) Patent No.: US 7,210,445 B1
(45) Date of Patent: May 1, 2007

(54) PISTON-CAM ENGINE

(76) Inventor: Ray O. Chaney, 3626 W. Demming Rd., Piqua, OH (US) 45356

( * ) Notice: Subject to any disclaimer, the term of this patent is extended or adjusted under 35 U.S.C. 154(b) by 10 days.

(21) Appl. No.: 10/907,567

(22) Filed: Apr. 6, 2005

Related U.S. Application Data

(63) Continuation-in-part of application No. 10/816,284, filed on Apr. 1, 2004, now Pat. No. 7,017,534.

(51) Int. Cl.
*F02B 75/32* (2006.01)

(52) U.S. Cl. ..... 123/197.4

(58) Field of Classification Search ..... 123/197.4, 123/197.1
See application file for complete search history.

(56) References Cited

U.S. PATENT DOCUMENTS 3,687,117 A * 8/1972 Panariti ..... 123/43 A
3,735,741 A * 5/1973 Hatz ..... 123/55.3
5,228,415 A * 7/1993 Williams ..... 123/51 R
5,273,011 A * 12/1993 Karlsson ..... 123/55.3
6,223,703 B1 * 5/2001 Galvin ..... 123/48 B
6,449,940 B2 * 9/2002 Nagel ..... 60/39.63
6,460,497 B1 * 10/2002 Hodgson ..... 123/90.31
6,622,471 B1 * 9/2003 Nagel ..... 60/39.6
6,796,284 B1 * 9/2004 Von Wielligh ..... 123/197.1
2002/0007814 A1 * 1/2002 Mansur ..... 123/197.1

* cited by examiner

*Primary Examiner*—Noah P. Kamen
*Assistant Examiner*—Jason Benton
(74) *Attorney, Agent, or Firm*—R. William Graham

(57) ABSTRACT

A piston-cam engine includes a drive cylinder, a drive piston operably disposed therein having a piston head and a shaft, a support frame having a drive shaft rotatably movably connected thereto, a cam connected to the drive shaft having a peripheral surface and having a plurality of lobes thereon, a roller member connected to the piston shaft and adapted for engagement with the peripheral surface of the cam, and a biasing element for biasing the roller member continuously against the peripheral surface of the cam.

4 Claims, 6 Drawing Sheets

PISTON-CAM ENGINE

This is a continuation in part of U.S. patent application Ser. No. 10/816,284 filed Apr. 1, 2004 now U.S. Pat. No. 7,017,534.

BACKGROUND OF THE INVENTION

1. Field of Invention

This invention relates to combustion engines with improvements therein. Particularly, the engine embodies a novel cam drive mechanism to increase power.

2. Prior Art

Conventional reciprocating piston type engines adopt a crankshaft and connecting-rod mechanism. In order to gain efficiency in power in the combustion engines, these types of engines have been modified to eliminate the crank shaft and connecting rod mechanism and made the engine more compact.

Prior modified systems have failed to provide suitable leak tightness found in reciprocating cylindrical pistons. Prior engine modifications have also employed a single shaft and connecting-rod mechanism to the piston for driving the same within the cylinder. These prior modifications use moving connecting rods. Variations of such prior engines fail to provide a suitable solution to prevent potential wear within the engine.

SUMMARY OF THE INVENTION

An object of the invention is to provide an improved combustion engine.

Another object of the invention is to provide a piston-cam engine which is smaller in volume than the conventional crankshaft and connecting-rod type engine having the same capacity.

Still another object is to provide a piston-cam engine of relatively high efficiency and torque.

Another object of the invention is to provide at least one slave piston which cooperates with a drive piston to reduce potential wear and force exerted on the drive piston.

Accordingly, the invention is directed to a piston-cam engine which includes a drive cylinder, a drive piston operably disposed therein having a piston head and a shaft, a support frame having a drive shaft rotatably movably connected thereto, a cam having a peripheral surface and having a plurality of lobes thereon, a roller member connected to the piston shaft and adapted for engagement with the peripheral surface of the cam, and a biasing element for biasing the roller member continuously against the peripheral surface of the cam. A support drive plate interconnects the piston shaft and the roller member and one or more slave cylinder(s) is provided adjacent the drive cylinder and has a slave piston operably disposed therein and has a piston head and a shaft, wherein the slave piston shaft is connected to the support drive plate to absorb part of a force exerted on the support plate during operation of the engine.

With the above and other objects in view, the invention further consists of the following novel features and details of construction, to be hereinafter more fully described, illustrated in the accompanying drawings and pointed out in the appended claims.

DETAILED DESCRIPTION OF THE PREFERRED EMBODIMENTS

Figure 1:
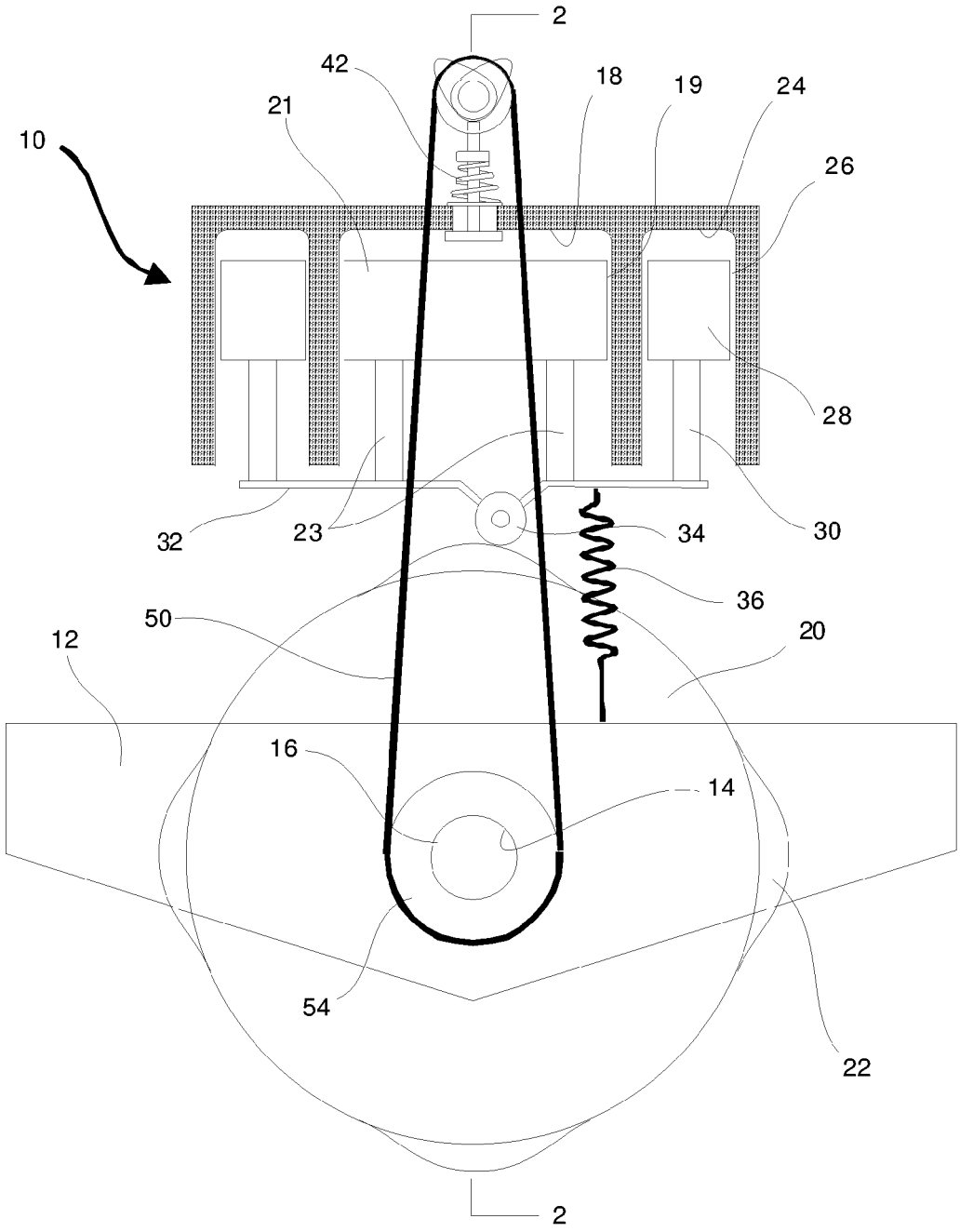
FIG. 1 is a sectional view taken through an embodiment of a piston-cam engine.
Figure 2:
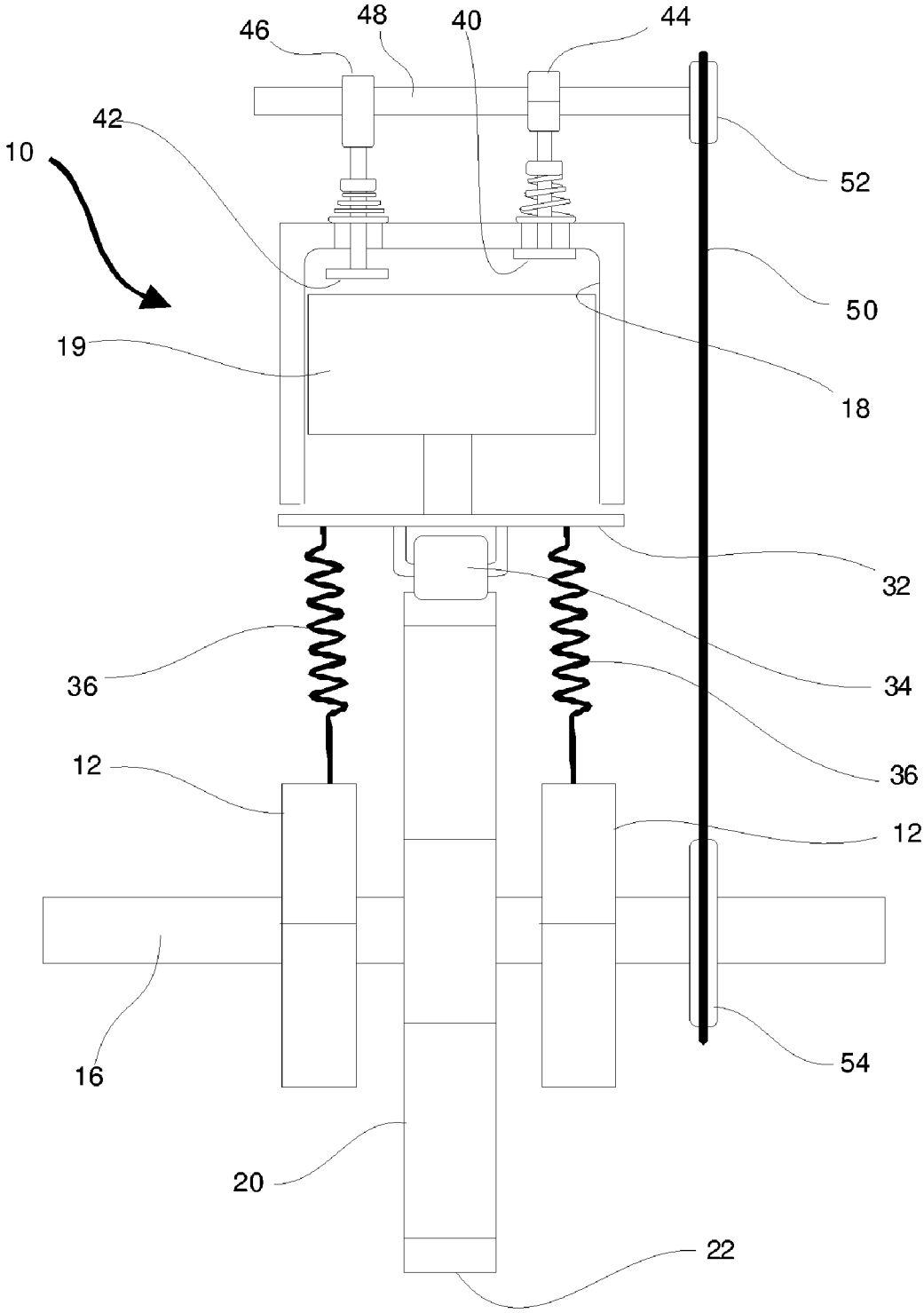
FIG. 2 is a longitudinal sectional view taken through line 2—2 of FIG. 2 of FIG. 1.
Figure 3:
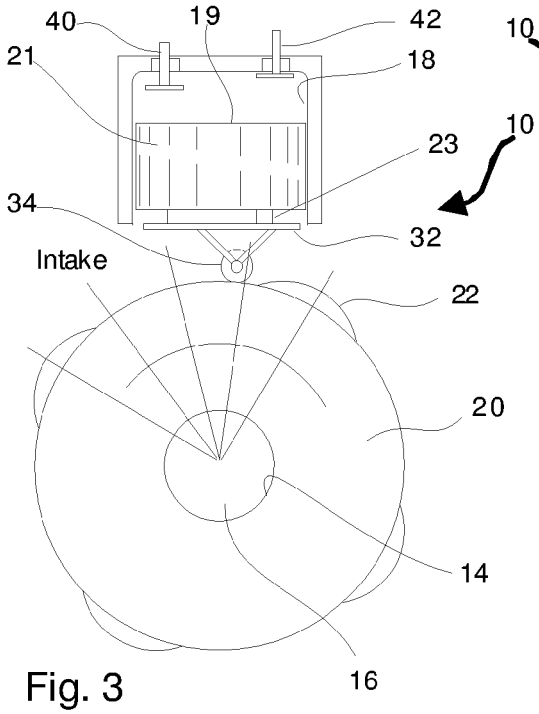
FIG. 3 is a cross sectional view illustrating an intake phase.
Figure 4:
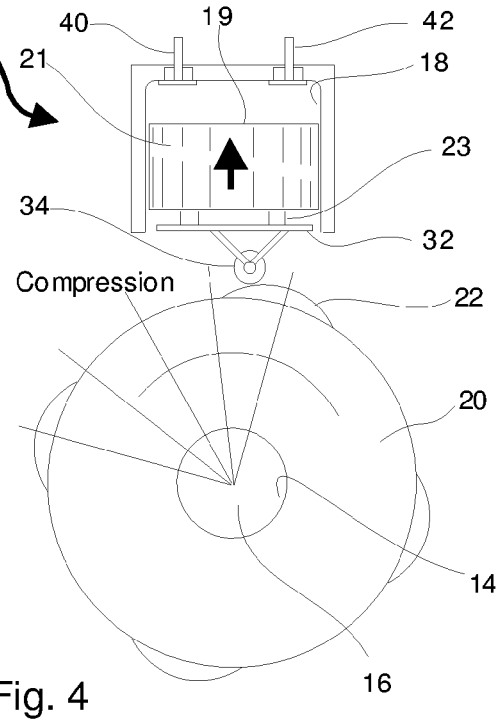
FIG. 4 is a cross sectional view illustrating a compression phase.
Figure 5:
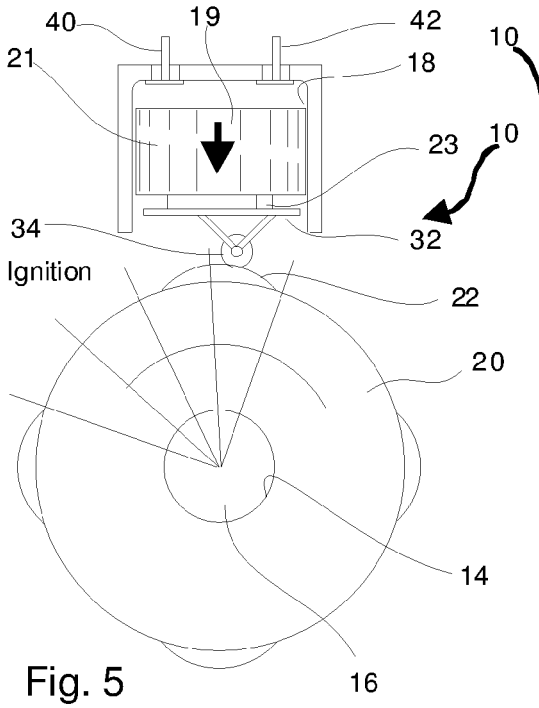
FIG. 5 is a cross sectional view illustrating an ignition phase.
Figure 6:
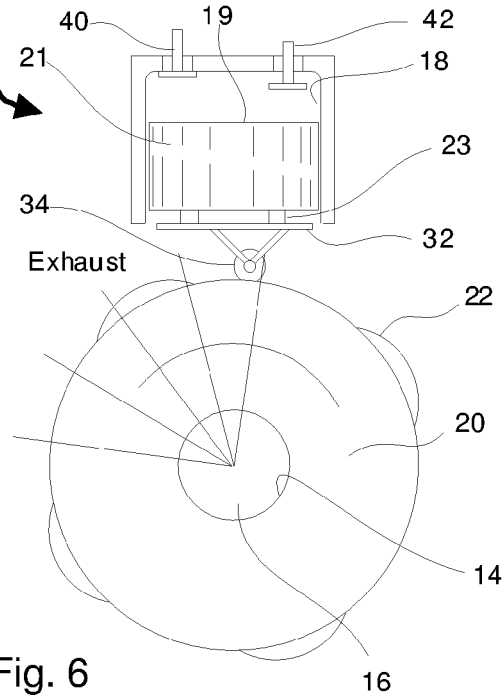
FIG. 6 is a cross sectional view illustrating an exhaust phase.

Referring now to the drawings in detail, where-in like characters of reference denote corresponding parts, the piston-cam engine is generally referred to by the numeral 10. The piston-cam engine 10 includes a support frame 12 mounted to a vehicle frame (not shown), for example, and has a generally cylindrical open bearing surface 14, to movably receive a drive shaft 16 the purpose of which will be presently apparent.

A drive cylinder 18 is operably disposed adjacent the drive shaft 16 which supports a cam 20 thereon which may be keyed, splined or otherwise rigidly connected thereto. A drive piston 19 is operably disposed within the cylinder 18. The drive piston 19 includes a head 21 and shafts 23. While there are two shafts 23, it is contemplated that one may be employed.

As illustrated in the drawings, the cam 20 includes a periphery face which is provided with a plurality of lobes 22. Here, there are four lobes 22 shown wherein the number of cycles in the engine are shown here as four. The number of lobes 22 is a proportional to the cycles to be achieved.

In a contemplated embodiment, there can be adjacent slave cylinders 24 and pistons 26, each piston 26 having a respective head 28 and shaft 30. The slave pistons 26/cylinders 24 are believed to lend stability adjacent inwardly disposed to the drive piston 19/cylinder 18.

A support drive plate 32 is fixed to ends of the piston shafts 23 and 30 and includes a roller member 34, such as roller bearings, adapted to lie flush against the periphery faces of the cam 20. In this regard, biasing means 36, such as a spring, interconnect the support drive plate 32 and the support frame 12 to assure a continuous contact is maintained between the roller member 34 and periphery faces of cam 20. As illustrated in the drawings, the cam 20 has rounded periphery faces to prevent friction when engaging the roller member 34.

As illustrated in FIGS. 3–6, the drive piston 19 exercises an intake phase, a compression phase, an ignition phase and hence driving phase and an exhaust phase. The cam 20 is initially set at about a 10 degree of dead center to begin the cycle. The Cylinder is equipped with a conventional intake valve 40 and exhaust valve 40 operably connected to cams, 44 and 46, respectively, which in turn are connected to a cam shaft 48. The cam shaft 48 is connected to the drive shaft 16 via a timing belt 50 and disks 52 and 54, the operation thereof is apparent from the drawings. It is contemplated that the valves 40 and 42 can be controlled with a solenoid or the like technology.

Figure 7:
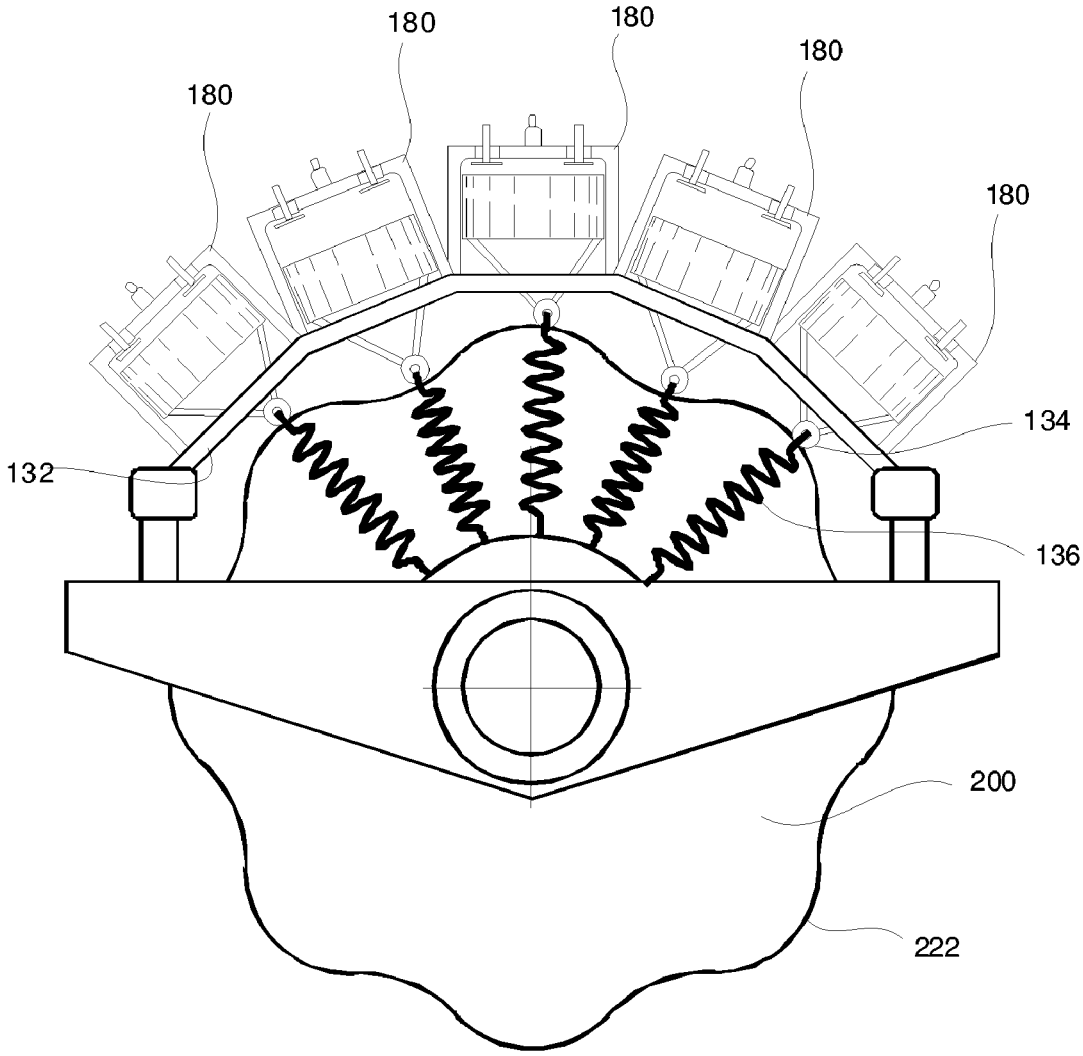
FIG. 7 illustrates another embodiment of the invention.
Figure 8:
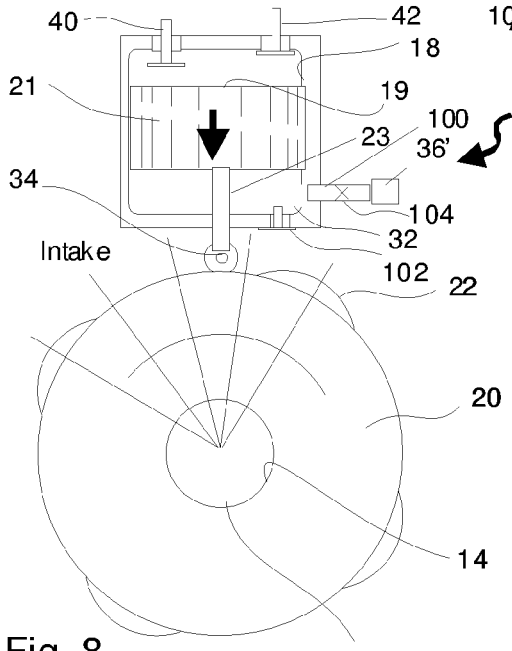
FIG. 8 is a cross sectional view illustrating an intake phase.
Figure 9:
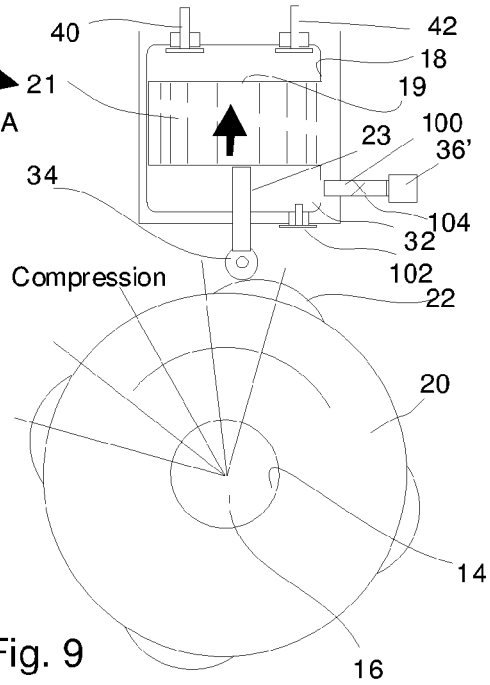
FIG. 9 is a cross sectional view illustrating a compression phase.
Figure 10:
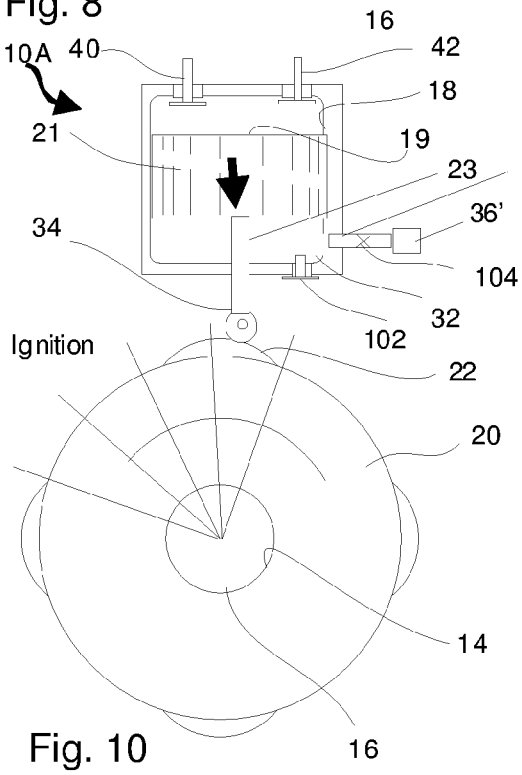
FIG. 10 is a cross sectional view illustrating an ignition phase.
Figure 11:
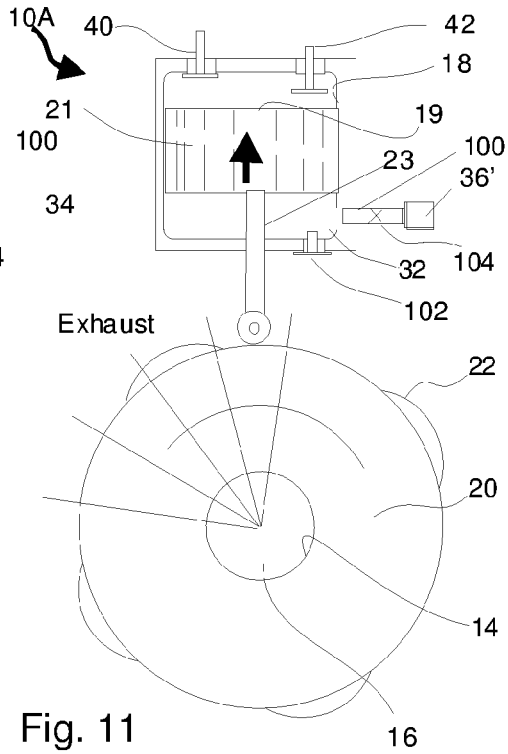
FIG. 11 is a cross sectional view illustrating an exhaust phase.

In FIG. 7, another embodiment 100 is illustrates which includes a cam 200 having eight lobes 222 disposed thereon. In this embodiment, there are a plurality of cylinders 180 disposed adjacent one another a distance sufficient from one another and in a spaced relation from the cam 200 to enable a complete cycle to be made from a peak of one lobe 222 to the next adjacent peak of the lobe 222. Here, the support frame 112 includes an upper frame portion 113 upon which the cylinders 180 are mounted. Biasing means 136 are connected to roller member support 132 and the support frame 112 to maintain the roller member 134 against the cam 200.

FIGS. 8–11 show yet another embodiment of the engine 10A. Here, the drive piston 19 is enclosed in cylinder 18 in a manner to have a constant vacuum on the bottom of the piston 19 when the engine is operating. Thus, a vacuum reservoir 36' is operably connected to the cylinder 18 through a port 100. This assures continuous contact is maintained between the roller member 34 and peripheral face of cam 20.

An air check valve 102 is provided in the bottom of the cylinder 18 to allow air to be driven out through the down stroke. As the piston is 19 is on the upstroke, it generates a vacuum on the bottom of the piston 19.

The vacuum reservoir 36' is only employed for starting the engine. A solenoid valve 104 can be energized to release a vacuum at the bottom of the drive piston 19. This in turn brings the roller member 34 in contact with peripheral face of cam 20. After the engine starts, the solenoid valve 104 is de-energized.

While the engine is running, drive piston 19 continues to create a constant vacuum at the bottom thereof. This causes a constant continuous contact of roller member 34 with the peripheral face of cam 20.

Figure 12:
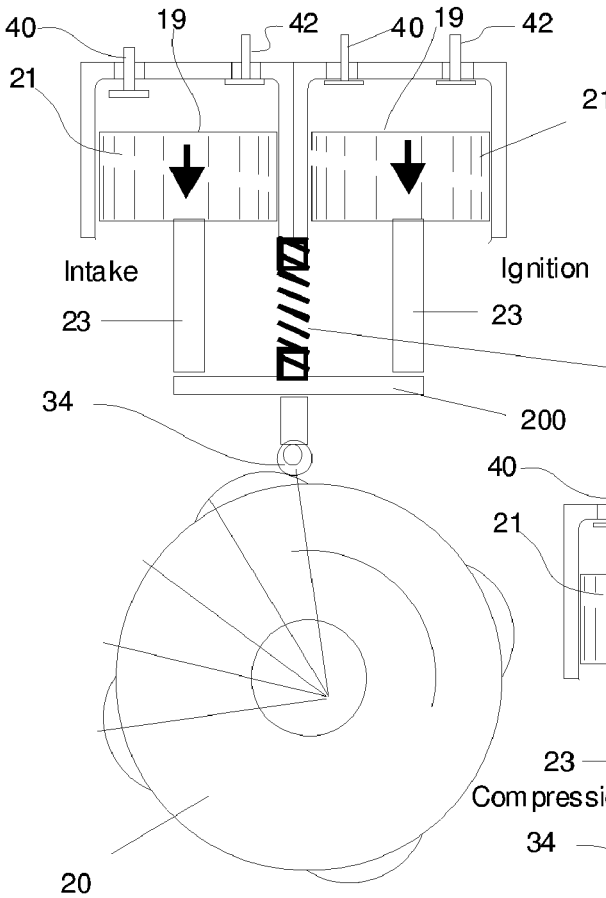
FIG. 12 is a cross sectional view illustrating another embodiment having both intake and ignition phases.
Figure 13:
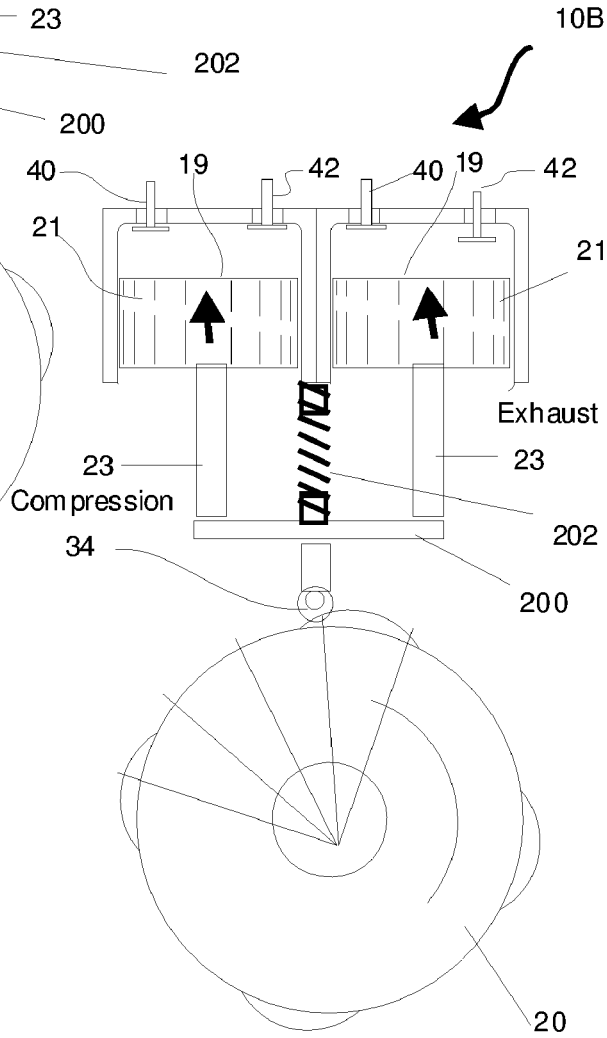
FIG. 13 is a cross sectional view illustrating another embodiment having both compression and exhaust phases.

Still, FIGS. 12 and 13 illustrate yet one more embodiment. This type of engine shows multiple drive pistons 19, each having a head 21 and shaft 23 which are interconnected by a support plate 200 having roller member 34 operably connected there below. The shafts 23 are equidistant from the roller member 34.

A compression spring 202 is provided for aiding during the starting phase. As shown in FIGS. 12 and 13, intake and ignition are tied together on the same stroke the engine 10B. This design assured a positive continuous contact between roller member 34 and peripheral face of cam 20.

FIG. 12 shows the intake side having valve 40 in an open position and exhaust valve 42 in a closed position with drive piston 19 in the intake position. Also, the ignition side has valve 40 in a closed position and exhaust valve 42 in a closed position with drive piston 19 in the ignition position.

FIG. 13 shows the compression side having valve 40 in a closed position and exhaust valve 42 in a closed position with drive piston 19 in the compression position. Also, the exhaust side has valve 40 in a closed position and exhaust valve 42 in an open position with drive piston 19 in the exhaust position.

It is readily seen that other cam may be constructed having more faces to operate a corresponding number of pistons commensurate with the stroke of the pistons and power to be derived or developed. By so providing, the present invention obviates the employment of piston rod shafts necessary in the make-up of the crank shaft engine. The invention provides less friction than other such systems and provides more output with minimal wear on associated parts.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations. Having described the invention,

What is claimed is:

1. A piston-cam engine, which includes:

a first drive cylinder;

a first drive piston operably disposed within said first cylinder having a piston head and a shaft;

a support frame having a generally cylindrical bearing surface;

a drive shaft rotatable movably received within said cylindrical bearing surface;

a cam connected to said drive shaft having a peripheral surface and having a plurality of lobes thereon;

a roller member connected to said first piston shaft and adapted for engagement with said peripheral surface of said cam; and biasing means for biasing said roller member continuously against said peripheral surface of said cam, wherein said biasing means includes means for creating a vacuum on a bottom of said piston, said vacuum means including an air check valve in a bottom of said first drive cylinder to allow air to be driven out therethrough a down stroke and wherein said first piston is on an upstroke, said check valve generates a vacuum on the bottom of said first drive piston.

2. The piston-cam engine of claim 1, which includes a support drive plate interconnecting said piston shaft and said roller member.

3. A piston-cam engine, which includes:

a first drive cylinder;

a first drive piston operably disposed within said first cylinder having a piston head and a shaft;

a support frame having a generally cylindrical bearing surface;

a drive shaft rotatably movably received within said cylindrical bearing surface;

a cam connected to said drive shaft having a peripheral surface and having a plurality of lobes thereon;

a roller member connected to said first piston shaft and adapted for engagement with said peripheral surface of said cam; and biasing means for biasing said roller member continuously against said peripheral surface of said cam, which further includes a second drive cylinder adjacent said first drive cylinder having a second drive piston operably disposed in said second drive cylinder and has a piston head and a shaft, a support plate interconnecting said first drive piston shaft and said second drive piston shaft and said roller member.

4. The piston-cam engine of claim 3, wherein said biasing means includes means for creating a vacuum on a bottom of said piston, said vacuum means including an air check valve in a bottom of said drive cylinders to allow air to be driven out therethrough a down stroke and wherein said pistons are on an upstroke, each said check valve generates a vacuum on the bottom of each said drive piston.

* * * * *